US007442876B2

(12) United States Patent
Iwasaki et al.

(10) Patent No.: US 7,442,876 B2
(45) Date of Patent: Oct. 28, 2008

(54) HIGH-PRECISION FOAMED COAXIAL CABLE

(75) Inventors: Mitsuo Iwasaki, Ibaraki (JP); Katsuo Tanaka, Ibaraki (JP)

(73) Assignees: Hirakawa Hewtech Corporation, Tokyo (JP); Advantest Corporation, Tokyo (JP)

( * ) Notice: Subject to any disclaimer, the term of this patent is extended or adjusted under 35 U.S.C. 154(b) by 93 days.

(21) Appl. No.: 11/597,383

(22) PCT Filed: May 23, 2005

(86) PCT No.: PCT/JP2005/009386

§ 371 (c)(1),
(2), (4) Date: Nov. 22, 2006

(87) PCT Pub. No.: WO2005/122188

PCT Pub. Date: Dec. 22, 2005

(65) Prior Publication Data

US 2007/0246242 A1 Oct. 25, 2007

(30) Foreign Application Priority Data

May 24, 2004 (JP) ..... 2004-153123

(51) Int. Cl.
*H01B 7/00* (2006.01)

(52) U.S. Cl. ..... 174/102 R

(58) Field of Classification Search ..... 174/102 R, 174/108, 110 R, 110 F, 36; 333/243
See application file for complete search history.

(56) References Cited

U.S. PATENT DOCUMENTS 5,210,377 A * 5/1993 Kennedy et al. ..... 174/107
5,429,869 A * 7/1995 McGregor et al. ..... 428/364
5,474,727 A * 12/1995 Perez ..... 264/154
5,554,236 A * 9/1996 Singles et al. ..... 156/52

(Continued)

FOREIGN PATENT DOCUMENTS

JP 06-181017 12/1992

(Continued)

OTHER PUBLICATIONS

Japanese Office Action dated Apr. 8, 2008 with English Translation.

(Continued)

*Primary Examiner*—William H Mayo, III
(74) *Attorney, Agent, or Firm*—McGinn IP Law Group, PLLC

(57) ABSTRACT

A high-precision foamed coaxial cable includes an internal conductor constructed by stranding conductors, an insulator constructed by winding a porous tape around an outer circumference of the internal conductor, and an external conductor constructed by braiding a plurality of thin conductor wires around an outer circumference of the insulator. The insulator is formed to have a right circle external shape, an outside diameter of the insulator is formed smaller at a reduction rate of 3 to 5% than the outside diameter, immediately after the winding, of the insulator. The external conductor is formed to have a right circle external shape, an outside diameter of the external conductor is formed smaller at a reduction rate of 2 to 4% than the outside diameter, immediately after the braiding, of the external conductor, and precision of its characteristic impedance is set at ±1 Ω.

10 Claims, 4 Drawing Sheets

U.S. PATENT DOCUMENTS

| | | | | |
|---|---|---|---|---|
| 5,750,931 | A * | 5/1998 | McGregor et al. | 174/110 PM |
| 6,337,443 | B1 * | 1/2002 | Dlugas et al. | 174/120 R |
| 6,963,032 | B2 * | 11/2005 | Yamaguchi et al. | 174/102 R |
| 7,355,123 | B2 * | 4/2008 | Kimura et al. | 174/102 R |
| 2005/0115728 | A1 * | 6/2005 | Saastamoinen et al. | 174/27 |

FOREIGN PATENT DOCUMENTS

| | | | |
|---|---|---|---|
| JP | 08-69717 | A | 3/1996 |
| JP | 2003-51220 | A | 2/2003 |
| JP | 2003-234026 | | 8/2003 |
| JP | 2003-234026 | A | 8/2003 |
| JP | 2003-308744 | | 10/2003 |
| JP | 2003-308744 | A | 10/2003 |
| WO | WO 03/067611 | A1 | 8/2003 |

OTHER PUBLICATIONS

Korean Office Action dated Sep. 4, 2007, and English translation.
International Search Report dated Sep. 28, 2006.

* cited by examiner

HIGH-PRECISION FOAMED COAXIAL CABLE

TECHNICAL FIELD

The present invention relates to a high-precision foamed coaxial cable in which an insulator is formed by winding a porous tape around an outer circumference of an internal conductor, and an external conductor is formed of a braided shielding member, and more particularly to a high-precision foamed coaxial cable in which, even if a mechanical stress such as bend, or torsion is applied to the cable, variation in characteristic impedance is less.

BACKGROUND ART

A demand for high-speed promotion for a transmission speed, and an improvement on transmission precision in information communication apparatuses, and semiconductor element testing/inspecting instruments or the like used in the information communication apparatuses has increased with the progress of a recent advanced information-oriented society. For this reason, the high-speed promotion for the transmission speed and the improvement on the transmission precision have been demanded even for a coaxial cable and a coaxial code which have been applied to these apparatuses and instruments.

A relative permittivity of an insulator, and outer diameters of an internal conductor and the insulator participate in transmission characteristics of the coaxial cable. The- transmission characteristics are improved as a value of the relative permittivity is smaller. Also, a ratio of the outer diameter of the internal conductor to the outer diameter of the insulator, and dispersion of the outer diameters of the internal conductor and the insulator largely participate in the transmission characteristics of the coaxial cable. In particular, with respect to a characteristic impedance and an electrostatic capacity, it is ideal that the relative permittivity of the insulator is small, its dispersion is less, dispersion of the outer diameter of the internal conductor and dispersion of the outer diameter (an inner diameter of a shielding layer) of the insulator are less, and the internal conductor and the insulator are formed to have a righter circle cylindrical shapes, respectively.

With regard to a high-precision foamed coaxial cable in which variation in characteristic impedance is reduced, a coaxial cable, for example, described in patent literary document 1 has been known.

Patent literary document 1 discloses a high-precision foamed coaxial cable including an internal conductor constructed by stranding a plurality of conductor wires, a foamed insulator, having a low permittivity, constructed by winding a porous tape around an outer circumference of the internal conductor, an external conductor constructed by braiding a large number of thin conductor wires around an outer circumference of the foamed insulator, and a sheath, made of a resin, having heat resistance, the sheath being formed around an outer circumference of the external conductor, in which precision of an outside diameter size of the internal conductor is set at 4/1000 mm or less, precision of an outside diameter size of the foamed insulator is set at ±0.02 mm, the foamed insulator is formed to have a right circle external shape, precision of an outside diameter size of the external conductor is set at ±2% of a central value of the outside diameter, the external conductor is formed to have a right circle shape, and precision of a characteristic impedance between the internal conductor and the external conductor between which the foamed insulator is interposed is set at ±1 Ω.

According to the high-precision foamed coaxial cable described in patent literary document 1, the irregularities of the external shapes, and the dispersion of the outside diameters in the internal conductor, the insulator, the external conductor and the like constituting the high-precision foamed coaxial cable can be reduced to enhance the precision of the outside diameter sizes, the members can be formed to have the right circle shapes, respectively, and the variation in characteristic impedance can be reduced.

Patent literary document 1: Patent Application Laid-Open No. 2003-234026

DISCLOSURE OF THE INVENTION

PROBLEM TO BE SOLVED BY THE INVENTION

However, according to the conventional high-precision foamed coaxial cable described in patent literary document 1, in order to reduce the variation in characteristic impedance of the cable, the insulated core and the external conductor core are pressingly inserted through dies having a predetermined inside diameter to be subjected to the secondary forming for the purpose of setting the outside diameters of the insulator and the external conductor at predetermined values, respectively, and of forming each of the external shapes thereof to have a right circle as much as possible. However, the secondary forming is merely carried out for the purpose of setting the finished outside diameters of the insulator and the external conductor at predetermined values, respectively, and of forming each of the external shapes thereof to have the right circle, and thus the insulator and the external conductor are not tightened. Therefore, it has not been said that a holding force for holding the internal conductor, and a shape maintaining force for maintaining the shape of the insulator itself are sufficiently strong in the insulator. -In addition, since the forming is not carried out in consideration of making the thickness of the external conductor constant, reduction of the variation in thickness of the external conductor, and tight contact of the external conductor to the insulator are not sufficiently realized.

For this reason, there is still room for an improvement on a problem that when a mechanical stress such as bend, torsion, or slide is applied to the cable, the external diameter and the external shape vary, and the characteristic impedance varies correspondingly. In particular, this problem is one that cannot be avoided in an electric wire or a cable in which an insulator is constructed by winding a porous tape having a porosity of 60% or more. In addition, this problem is one that should be solved as quickly as possible in the cable applied to the above-mentioned instruments or the like for testing/inspecting the semiconductor elements or the like.

In addition, the high-precision foamed coaxial cable, for example, is applied to the information communication apparatuses and the semiconductor element testing/inspecting instruments or the like applied to the information communication apparatuses. However, with regard to the characteristics required for the coaxial cable applied to these apparatuses and instruments, it is given that the coaxial cable has the flexibility, the mechanical stress such as bend, torsion, or slide exerts merely a less influence on the coaxial cable, the coaxial cable has the stable transmission characteristics, especially, the stable characteristic impedance, and thus even when the mechanical stress is applied to the coaxial cable, the variation in characteristic value is less.

Here, the following conditions are required to meet the conditions in which the coaxial cable has the flexibility, and withstands the mechanical stress such as bend, torsion, or slide.

(1) Each of strands constituting the internal conductor has the flexibility, and when the stranded wire is constructed by stranding the strands, each of the strands is movable.

(2) The internal conductor and the insulator are not brought in tight contact and integrated with each other, and thus they are individually movable.

(3) The external conductor is constructed in the form of a braiding member, and each of the strands of the braiding member is free in motion.

(4) The insulator and the external conductor are not brought in tight contact and integrated with each other, and thus they are individually movable.

(5) The external conductor and the sheath are not brought in tight contact and integrated with each other, and thus they are individually movable.

In a word, it is required that each of the members constituting the cable is free.

On the other hand, the following conditions are required to enhance the precision of the characteristic impedance of the coaxial cable.

(1) The strands constituting the internal conductor are formed integrally with one another to have a right circle shape, and thus the variation in its outside diameter is less.

(2) The insulator has a constant relative permittivity, and is formed to have a right circle shape. Thus, the insulator has the less variation in its outside diameter and is brought in tight contact and integrated with the internal conductor. In addition, the insulator itself has the shape maintaining force.

(3) The external conductor is integrally constructed to have a right circle shape, has no variation in its outside diameter and thickness, and is brought in tight contact and integrated with the insulator.

(4) The sheath is brought in tight contact and integrated with the external conductor, and regulates the motion of the external conductor in its inside.

In short, the shape maintaining force of the insulator is required to construct the cable and to enhance the precision of the characteristic impedance. Thus, it becomes the indispensable conditions that the constituent members are brought in tight contact and integrated with one another and are finished to have the right circle shapes, respectively, to reduce the variation in their outside diameters, and the relative permittivity is fixed.

That is to say, the conditions required to meet that the coaxial cable has the flexibility, and even if the mechanical stress such as bend, torsion, or slide is applied to the coaxial cable, withstands the mechanical stress applied thereto, and the conditions required to enhance the precision of the characteristic impedance are diametrically opposite to each other. Hence, it has been difficult to realize the coaxial cable which has the flexibility, and even if the mechanical stress is applied thereto, withstands the mechanical stress, and has the extremely precise characteristic impedance.

Therefore, it is an object of the present invention to provide a high-precision foamed coaxial cable which is capable of solving the above-mentioned problem.

MEANS FOR SOLVING PROBLEM

In order to attain the above-mentioned object, the present invention provides a high-precision foamed coaxial cable including an internal conductor constructed by stranding conductors, an insulator constructed by winding a porous tape around an outer circumference of the internal conductor, and an external conductor constructed by braiding a plurality of thin conductor wires around an outer circumference of the insulator, in which the insulator is formed to have a right circle external shape, an outside diameter of the insulator is formed smaller at a reduction rate of 3 to 5% than the outside diameter, immediately after the winding, of the insulator, the external conductor is formed to have a right circle external shape, an outside diameter of the external conductor is formed smaller at a reduction rate of 2 to 4% than the outside diameter, immediately after the braiding, of the external conductor of the external conductor, and precision of its characteristic impedance is set at ±1 Ω.

A preferred embodiment of the present invention is characterized by including the following constructions.

(1) A cross section of the insulator is compressively formed smaller at 90% than that, immediately after the winding, of the insulator.

(2) A biting rate of the external conductor in the insulator is set equal to or larger than 10% and smaller than 35%.

(3) Variation in characteristic impedance when a mechanical stress in winding the high-precision foamed coaxial cable around a rod having a diameter of 5.0 mm is applied to the high-precision foamed coaxial cable falls within a range of ±5 Ω.

(4) Precision of an outside diameter size of the internal conductor is set in a range of ±4/1000 mm, precision of an outside diameter size of the insulator is set at ±0.02 mm, and precision of an outside diameter size of the external conductor is set at ±2% of a central value of the outside diameter.

(5) The porous tape has a porosity of 60% or more, and is wound around the internal conductor with a winding force of 0.70 kg/mm$^2$, at a winding interval which is 9 to 10 times as large as an outside diameter of the internal conductor, and at a winding angle of 75 to 80°.

(6) The external conductor is constructed by braiding a two-layer plated annealed copper wire, having an outside diameter tolerance of ±2/1000 mm, which is obtained by plating a silver plated annealed copper wire having a thickness of 1 to 3 μm with a tin alloy having a thickness of 0.2 to 0.5 μm, and when a finished thickness in a phase of the braiding process is set as being 1, is formed to have a right circle external shape, and has variation in its thickness set at 5 to 10%.

(7) The external conductor is constructed by braiding a two-layer plated annealed copper wire, having an outside diameter tolerance of ±2/1000 mm, which is obtained by plating a nickel plated annealed copper wire having a thickness of 1 to 3 μm with a tin alloy having a thickness of 0.2 to 0.5 μm, and when a finished thickness in a phase of the braiding process is set as being 1, is formed to have a right circle external shape, and has variation in its thickness set at 5 to 10%.

(8) The tin alloy plating contains therein tin and copper, and a content of copper is in a range of 0.6 to 2.5%.

EFFECTS OF THE INVENTION

According to the present invention, it is possible to provide the high-precision foamed coaxial cable which is capable of maintaining the external shapes and outside diameters of the insulator and the external conductor, respectively, because even if the mechanical stress such as bend, torsion, or slide is applied to the high-precision foamed coaxial cable, the variation in shape of each of the insulator and the external conductor is less and thus of reducing the variation in characteristic impedance.

DESCRIPTION OF REFERENCE NUMERAL

Figure 1A:
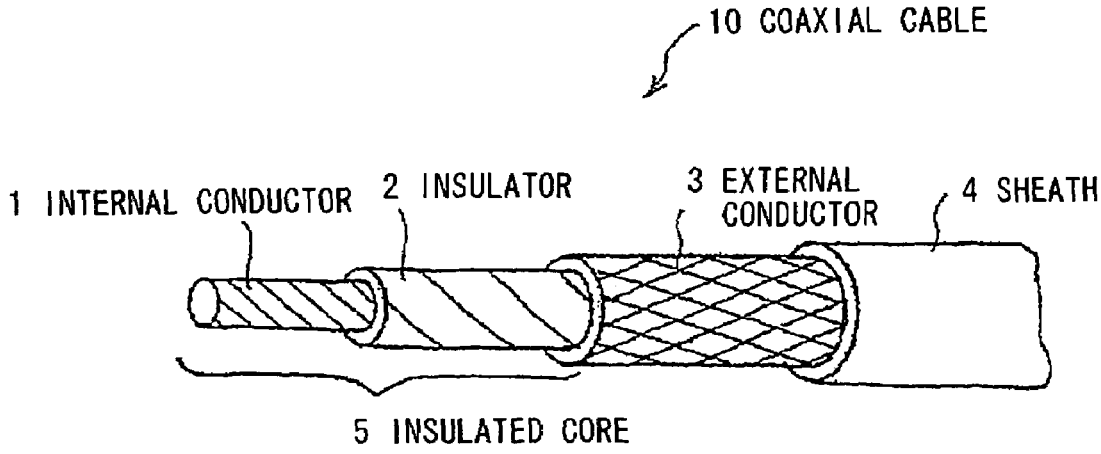
[FIG. 1, including FIG. 1A and FIG. 1B] A schematic view showing a construction of a high-precision foamed coaxial cable of the present invention.

1 internal conductor
2 insulator
3 external conductor
4 sheath
5 insulated core
10 coaxial cable
15 tape supplying portion
21 porous tape
30*a*, 30*b*, 30*c* guide dies
31*a*, 31*b* forming dies
40 braiding device
41, 42 guide dies
43 forming dies
44 strand for braiding

BEST MODE FOR CARRYING OUT THE INVENTION

Although an embodiment of the present invention will be described hereinafter with reference to the drawings, the present invention is not limited thereto.

(Construction of Overall High-Precision Foamed Coaxial Cable)

Figure 1B:
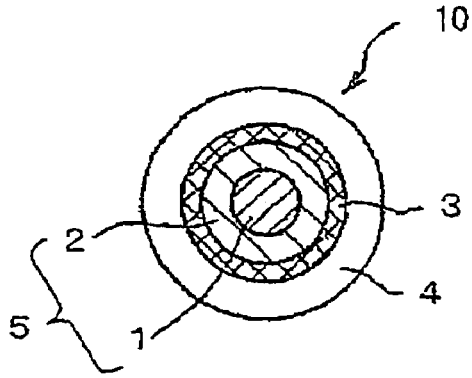

FIG. 1 is a schematic view showing a construction of a high-precision foamed coaxial cable according to an embodiment of the present invention. The high-precision foamed coaxial cable shown in FIG. 1 is constructed by coating an internal conductor 1 having a plurality of strands with an insulator 2, an external conductor 3 constructed as a braiding member, and a sheath 4 in this order.

Figure 2A:
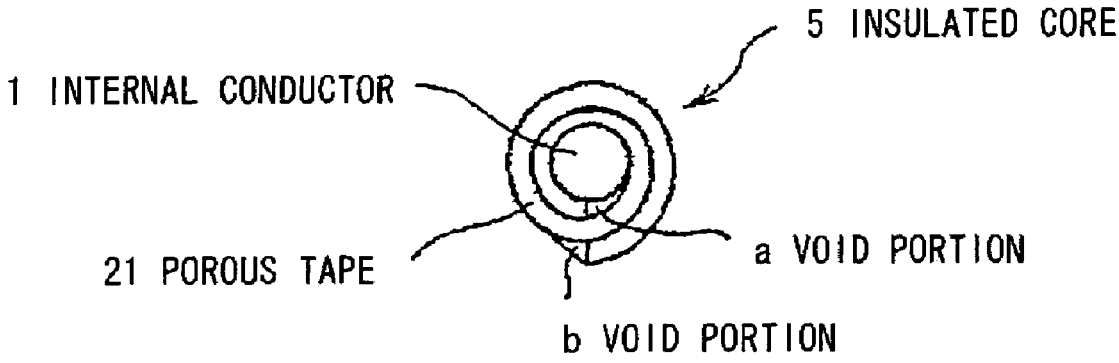
[FIG. 2, including FIG. 2A and FIG. 2B] A schematic view showing a construction of an insulated core portion of the high-precision foamed coaxial cable according to an embodiment of the present invention.
Figure 2B:
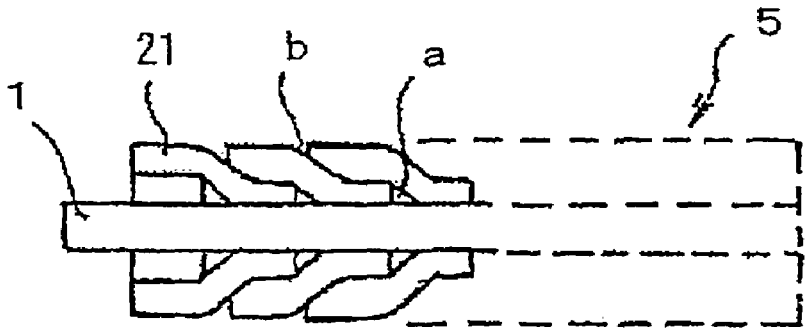

FIG. 2 is a schematic view showing a construction of an insulated core portion of the high-precision foamed coaxial cable according to the embodiment of the present invention. The insulated core 5 includes the internal conductor 1 and the insulator 2. Specifically, the insulated core 5 is constructed by winding a porous tape 21 as an insulator around the internal conductor 1.

(Constructions of Portions of High-Precision Foamed Coaxial Cable)

The internal conductor 1 is constructed in the form of stranded wires, each of the strands is movable, a stranding outside diameter is unified, the variation in stranding outside diameter is less, and the internal conductor 1 is constructed to have a right circle shape. Specifically, for example, the internal conductor 1 (a conductor size is described with an example to which AWG#26 is applied) is constructed by stranding seven annealed copper wires. In this case, one annealed copper wire is plated with silver to have a thickness of 1 to 3 μm, has an outside diameter of 0.16 mm, and has the outside diameter precision set at 2/1000 mm or less. In order that the flexibility may be improved, the high-precision foamed coaxial cable may withstand the mechanical stress even when the mechanical stress such as bend, torsion, or slide is applied to the high-precision foamed coaxial cable, and the tight contact of the insulator 2 constructed through the winding to the internal conductor 1 may be improved, the stranding pitch is desirably set to be 15 times or less as large as the finished outside diameter, and the precision of the outside diameter of the internal conductor 1 is desirably set at 4/1000 mm or less.

The insulator 2 is constructed in the form of a porous tape 21, is brought in tight contact to the internal conductor 1, the variation in its relative permittivity, thickness and outside diameter is less, and the insulator 2 is constructed to have a right circle external shape. Also, the insulator 2 itself is given a shape maintaining force for maintaining the shape.

When the outside diameter of the insulator 2 constructed by winding the porous tape 21 is set as being 1, the insulator 2 is constructed to have the right circle external shape through the secondary forming, and its finished outside diameter is set in the range of 0.95 to 0.97 at a reduction rate of, preferably, 3 to 5%, and more preferably, 3.5 to 4.5%, so that void portions defined between the internal conductor 1 and the insulator 2 are unified. The tight contact and integration results in that even if the mechanical stress such as bend, torsion, or slide is applied to the high-precision foamed coaxial cable, it is possible to reduce the variation in characteristic impedance.

In particular, when the cross section of the insulator 2 constructed by winding the porous tape 21 is set as being 1, the compression of the finished cross section of the insulator 2 to about 90% (0.9) through the secondary forming is desirable because the insulated core has the flexibility and the variation in characteristic impedance can be reduced.

When the porous tape 21 has a low permittivity and has a porosity of 60% or more, its precision is set at ±5%, a tolerance of its thickness is set at ±3 μm, and a compressive stress is set in the range of 0.24 to 0.28 kg, a fired porous polytetrafluoroethylene (PTFE) tape having a compressive deformation strain of 0.6 to 0.8% is applied. In this case, the porous tape 21 is desirably constructed by winding the PTFE tape which is 4.6 mm in width and 0.09 mm in thickness on a half-lap basis, and by further winding the PTFE tape which is 6.9 mm in width and 0.09 mm in thickness on a half-lap basis.

A winding angle of the tape, in order to further strengthen the tight contact thereof, is preferably set in the range of 65 to 90°, more preferably in the range of 70 to 85°, and much more preferably in the range of 75 to 80°. A winding internal of the tape is set to be preferably 7 to 12 times as large as the outside diameter of the internal conductor, more preferably 8 to 11 times as large as the outside diameter of the internal conductor, and much more preferably 9 to 10 times as large as the outside diameter of the internal conductor. A winding tensile force is set preferably in the range of 0.55 to 0.85 kg/mm$^2$, more preferably in the range of 0.60 to 0.80 kg/mm$^2$, much more preferably in the range of 0.65 to 0.75 kg/mm$^2$, and most preferably at about 0.70 kg/mm$^2$. A winding direction is desirably set to a direction opposite to a stranding direction of the internal conductor 1 in a first tape winding phase, and set to a direction opposite to the first tape winding direction in a next tape winding phase. It is desirable that the variation in thickness of the insulator 2 after the winding is set at ±0.01 mm, and the variation in outside diameter thereof is set at ±0.02 mm.

A method in which the insulator 2 is constructed to have the right circle external shape, and its finished outside diameter is reduced to compress the cross section of the insulator 2, so that the void portions defined between the internal conductor 1 and the insulator 2 are unified is implemented by pressingly inserting the insulated core 5 through forming dies for forming the outside diameter of the insulator into predetermined one, after the winding of the tape, or in the phase of formation of a braiding member layer which will be described later, thereby subjecting the insulated core 5 to forming processing. The forming processing is performed in order to remove void portions a and b caused in the circumference of the internal conductor 1 and the outside of the insulator 2, respectively, by winding the porous tape 21 shown in FIG. 2(*a*) and (*b*) to realize the tight contact of the insulator 2 to the internal conductor 1, thereby removing the irregularities of the outer and inner circumferences of the insulator 2 due to the winding. The performing of this processing results in that the thickness of the insulator is unified, the dispersion in outside diameter of the insulator is removed, and the insulator is formed to have the right circle cylindrical external shape. For example, after the outside diameter of the wound tape is set at 1.25 mm, the forming is performed by applying the forming dies which are 1.20 mm in diameter and 3.0 mm in length. The setting of the forming speed at 10 m/min results in that the forming is stably performed, the tight contact of the insulator 2 to the internal conductor 1 is further strengthened, and the shape maintenance for the insulator 2 itself is enhanced.

The external conductor 3 is constructed in the form of the braiding member, the sliding property of each of the strands is improved, and the external conductor 3 has the flexibility and is brought in tight contact and integrated with the insulator 2, thereby reducing the variation in outside diameter and thickness of the external conductor 3. Thus, the external conductor 3 is constructed to have a right circle shape in its inside diameter, and the external conductor 3 itself maintains its shape.

An annealed copper wire having an outside diameter of 0.05 to 0.10 mm is applied to the external conductor 3, a plating layer, made of silver or nickel, having a thickness of 1 to 3 μm is formed on the outer circumference of the annealed copper wire, and a plating layer, made of a tin alloy, having a thickness of 0.20 to 0.50 μm is further formed thereon. Thus, an annealed copper wire including the two plating layers and having an outside diameter tolerance of ±2/1000 mm is applied to the external conductor 3. Thus, the external conductor 3 is constructed by braiding the annealed copper wires at a predetermined braiding angle and with a braiding density of 95% or more. Thus, the external conductor 3 is formed with braiding outside diameter precision of ±2%.

The reason for application of the braiding member to the external conductor 3 is because when the mechanical stress such as bend, torsion, depression, or slide is applied to the high-precision foamed coaxial cable, no damage is applied to each of the insulator 2 and the external conductor 3 and the cable is given the flexibility.

In addition, the reason for application of the annealed copper wire having the two plating layers consisting of the plating layer made of silver, nickel or the like, and the plating layer made of the tin alloy to the strand for braiding is that a frictional resistance of the surface of the strand is reduced to improve the sliding property, and when the mechanical stress is applied to the cable, each of the strands is easy to move to disperse the stress, thereby preventing the stress from influencing the insulator 2, and that the shape of the braiding member is maintained to hold the insulator 2, the buckling of the braiding member is prevented and also the release of the internal stress is prevented.

The reason for provision of the tin alloy plating layer on the outer circumference of each of the strands is because in addition to the improvement on the sliding property, the whiskers are prevented from being generated. The tin alloy contains therein tin and copper, and a content of copper is in the range of 0.6 to 2.5%. Also, in addition thereto, a plating layer which, for example, contains therein 0.3 to 3.5% silver and 1 to 10% bismuth and which is generally called lead-free solder plating can also be applied to the strand. From a viewpoint of the plating structure of each of the strands, it is effective to apply tin plating having a large electric conductivity and a small dynamic coefficient of friction. However, when tin is independently used at high temperatures, copper diffuses into the tin plating layer, and generation and growth of the whiskers are accelerated due to the diffusion stress. Thus, the short-circuit between the internal conductor 1 and the external conductor 3 due to the grown whiskers must be prevented. In order to prevent the whiskers from being generated, it is effective that copper contained in the inside is prevented from diffusing, an additive is added to tin, the internal stress due to the heat treatment is reduced, and the plating layer is thinned. Here, the provision of the plating layer made of silver plating, nickel plating or the like results in that copper is prevented from diffusing. However, since such a plating layer has the large dynamic coefficient of friction, the motion among the strands becomes poor, and the flexibility of the cable is lost.

In order to give the cable the flexibility by improving the motion among the strands, an annealed copper wire is applied which was obtained by further forming a tin alloy hot-dipping layer having a thickness of 0.20 to 0.50 μm on the above-mentioned plating layer. A thickness of the base plating layer made of silver or nickel is set in the range of 1 to 3 μm. The reason for this is because although the plating layer must have the thickness of 1 μm or more in order to prevent copper from diffusing, when the plating layer is too thick, this exerts a bad influence on the flexibility of the cable. When the thickness of the tin alloy plating is set at 0.2 μm or less, the base silver plating is exposed, and thus the tin alloy plating is lacking in flexibility. On the other hand, when the thickness of the tin alloy plating is set at 0.5 μm or more, the whiskers are easy to generate. Here, describing an outline of the dynamic coefficients of friction of the metals, silver is 1.30, copper is 0.90, and the tin alloy is 0.55. It can be understood from these values that it is effective to apply the tin alloy plating having the small dynamic coefficient of friction to each of the strands for braiding. Note that, the dynamic coefficients of friction of the metals were measured by using a Bowden type light-load abrasion tester.

The braiding member is formed with the outer diameter precision of ±2%, whereby the braiding member layer is narrowed in a direction of its length. Thus, the void portions in the braiding member itself are removed, and the braiding member is brought in tighter contact to the insulator so that the void portions defined between the braiding member and the insulator are removed. As a result, the braiding member is closer to the right circle cylindrical shape in its inside diameter, the characteristic impedance is fixed, and the variation in characteristic impedance becomes less.

When the outside diameter of the external conductor 3 constructed by braiding the conductor strands is set as being 1, the external conductor 3 is formed to have the right circle external shape through the secondary forming so that its finished outside diameter is set in the range of 0.96 to 0.98 at a reduction rate of, preferably, 2 to 4%, and more preferably, 2.5 to 3.5%, the dispersion of its thickness is set in the range of ±5%, and the variation in its thickness and outside diameter is reduced. Even if the mechanical stress such as bend, torsion, or slide is applied to the cable, the tight contact and integration makes it possible to reduce the variation in characteristic impedance.

In particular, it is desirable that a rate at which, during the reduction of the outside diameter, the external conductor 3 (braided strands) bites in the insulator 2 (Hereinafter it is referred to as "a biting rate". For example, when the outside diameter of each of the braided strands is 0.1 mm and the braided strands are depressed against the insulator by 0.02 mm, the biting rate is expressed by 0.02/0.1×100% =20%) is preferably equal to or larger than 10% and smaller than 35%, more preferably equal to or larger than 10% and equal to or smaller than 30%, and much more preferably equal to or larger than 15% and equal to or smaller than 25%.

When the flexibility is taken into consideration, the larger an angle of each of the thin conductor wires at which the external conductor 3 is braided with respect to the outside diameter of the insulator 2 (an angle at which the thin conductor wires are braided around the outer circumference of the insulator 2) the better. In this case, however, the variation in thickness, outside diameter and the like of the braiding member becomes large, and hence the tight contact of the external conductor 3 to the insulator 2 becomes poor. Therefore, it is desirable that the braiding angle is preferably set in the range of 65 to 80°, and more preferably in the range of 70 to 75°.

A method in which the external conductor 3 is constructed to have the right circle external shape, its finished outside diameter is reduced, and the biting rate is set in a predetermined range is implemented by performing the forming processing in which the core with the braiding member layer is inserted through the forming dies for forming the outside diameter of the braiding member layer into the predetermined outside diameter after the braiding or in the phase of the forming of the sheath 4 of the coaxial cable as will be described later. As a result, the braiding member can be brought in tighter contact to the insulator 2, the variation in its thickness, outside diameter and the like can be reduced, and the void portions within the braiding portion can be reduced. Thus, the shape maintaining force of the external conductor can be increased. For example, the insulated core with the external conductor having the outside diameter of 1.55 mm is pressingly inserted through the forming dies having the inside diameter of 1.51 mm to be formed. The forming speed is set in the range of 1 to 2 m/min, which results in that the tight contact of the external conductor 3 to the insulator 2 can be further strengthened, the thickness of the external conductor 3 can be unified, and the dispersion in thickness of the external conductor 3 can be set in the range of ±5%

The thickness of the FEP resin is made 0.5 times or more as large as that of the external conductor 3, and the force of the tight contact to the braiding member layer is set at 20 g/mm$^2$ or more at 23° C. Under this condition, the sheath 4 is constructed by subjecting the FEP resin to the extrusion. Here, the reason for limiting the thickness of the sheath 4 is that when the mechanical stress is applied to the cable, the shape of the braiding member is maintained and thus the buckling is prevented. The reason for limiting the tight contact force is because when the tight contact force is set smaller than 20 g/mm$^2$, the release of the internal stress in the braiding member cannot be suppressed, and as a result, the precision of the characteristic impedance is lacking in stability. When the tight contact force is set at 20 g/mm$^2$ or more, the release of the internal stress can be suppressed.

(Method of Fabricating High-Precision Foamed Coaxial Cable)

Figure 3:
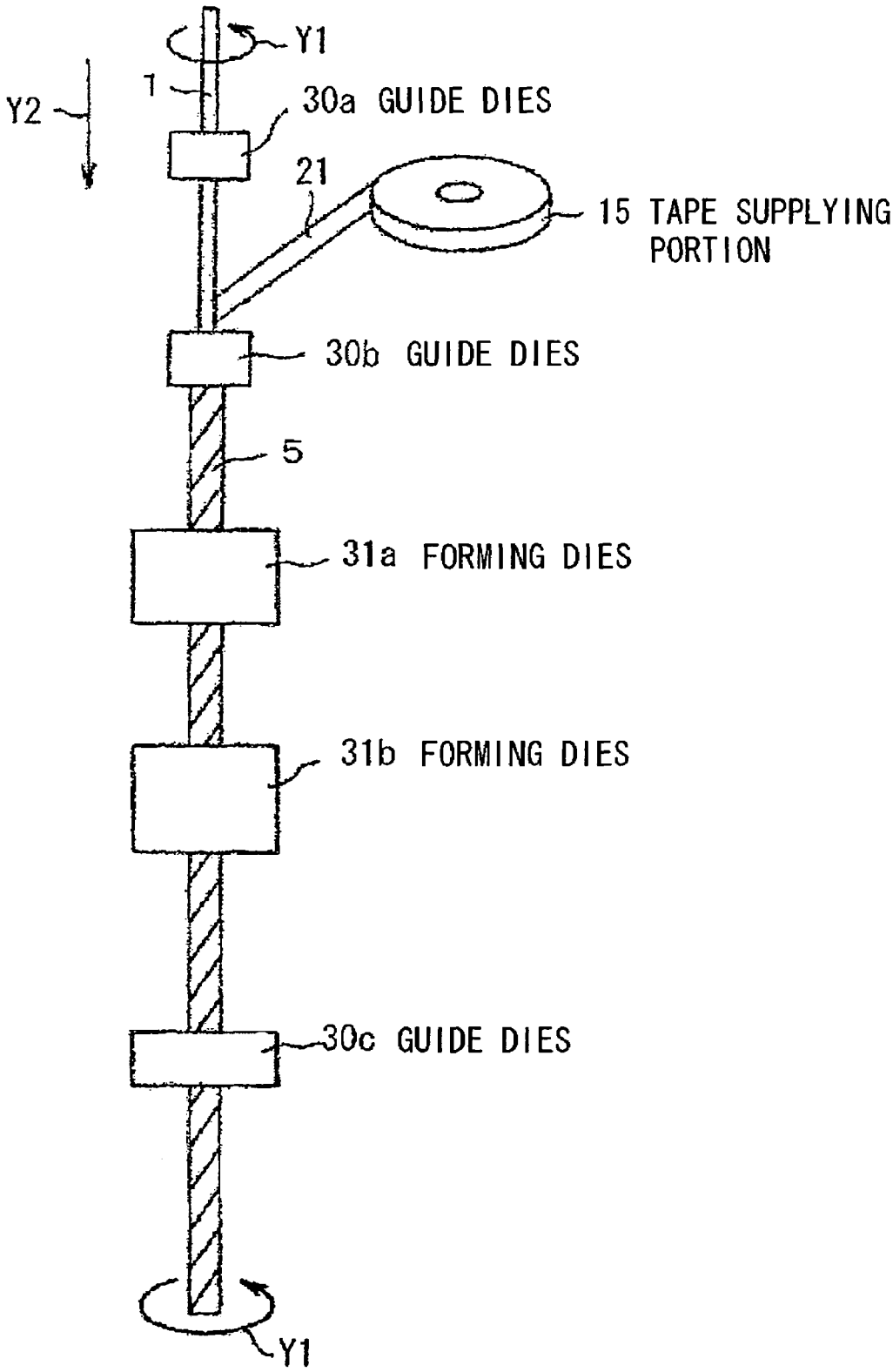
[FIG. 3] A view explaining a method of winding a porous tape around an internal conductor and a method of forming an outside diameter of an insulator.

FIG. 3 is a view explaining a method of winding the porous tape around the internal conductor, and a method of forming the outside diameter of the insulator. The method of winding the porous tape 21, and the method of forming the outside diameter of the insulator 2 will now be described with reference to FIG. 3.

The internal conductor 1 constructed as the stranded conductors is supplied from a supplying portion (not shown) to first, second and third guide dies 30*a*, 30*b* and 30*c*, and forming dies 31*a* and 31*b* of a tape winding device. The internal conductor 1 thus supplied is rotated at a predetermined rotational frequency in a direction indicated by an arrow Y1. The internal conductor 1 being rotated is fed at a predetermined speed in a direction indicated by an arrow Y2, whereby after the internal conductor 1 passes through the first guides dies 30*a*, the porous tape 21 which is supplied from a tape supplying portion 15 is wound around the internal conductor 1 on this side of the second guide dies 30*b*. This process is such that an angle of the porous tape 21 with the internal conductor 1 is set at 80° and a tape tensile force is set at 300 g, and under this condition, the porous tape 21 is wound around the outer circumference of the internal conductor 1 on a half-lap basis by rotation of the internal conductor 1 itself in the direction indicated by the arrow Y1, and the tape is wound around the outer circumference thereof once more.

A tape-wound-member which was obtained by winding the porous tape 21 around the outer circumference of the internal conductor 1 in such a manner and which passed through the second guide dies 30*b* is inserted through the first and second forming dies 31*a* and 31*b* disposed between the second and third guide dies 30*b* and 30*c*. Here, the porous tape 21 is formed with the variation of ±2% in its outside diameter by using the first forming dies 31*a* having an inside diameter of 1.13 mm and an inside diameter length of 3.0 mm. The porous tape 21 passed through the first forming dies 31*a* is then inserted through the second forming dies 31*b* having an inside diameter of 1.12 mm and an inside diameter length of 3.00 mm. Thus, the porous tape 21 is formed with a tolerance of a predetermined outside diameter to have the predetermined outside diameter. By performing the above forming processing, the porous tape 21 is formed to have the right circle cylindrical shape in its outside diameter, the tight contact to the internal conductor 1 is improved, and the ununiformity of the thickness, the irregularities of the outside diameter, the dispersion in outside diameter, and the like are reduced. When the forming for the porous tape 21 is more smoothly performed by using the forming dies 31*a* and 31*b*, it can also be performed while the forming dies 31*a* and 31*b*, and the like are rotated with predetermined rotational frequencies, respectively. Moreover, when the tape winding, and the firing for the porous tape are simultaneously performed, the forming dies 31*a* and 31*b* may also be heated at a firing temperature.

Figure 4:
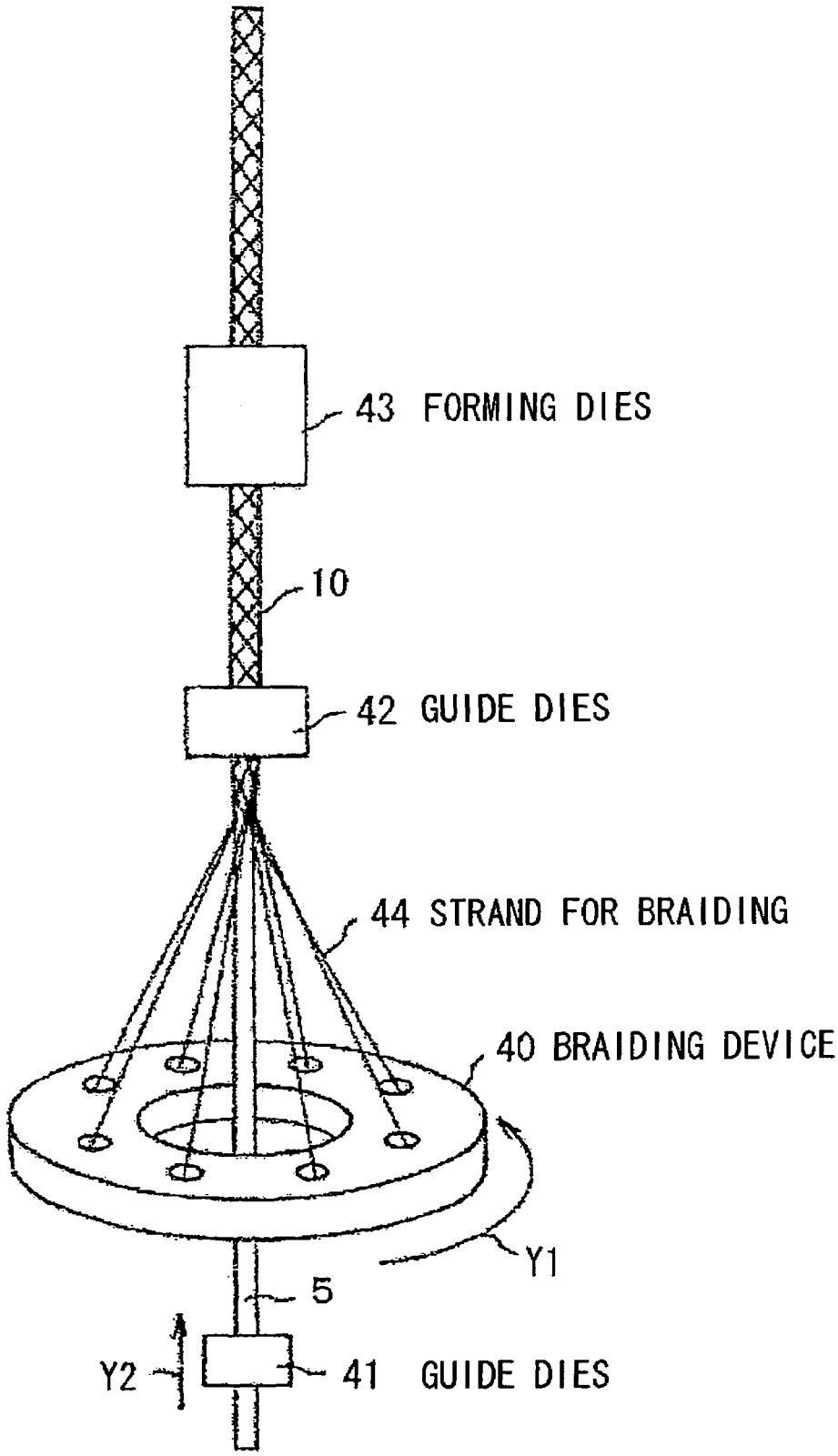
[FIG. 4] A view explaining a method of braiding a braiding member around the insulated core and a method of forming an outside diameter of an external conductor.

FIG. 4 is a view explaining a method of braiding the braiding member around the insulated core, and a method of forming the outside diameter of the external conductor. An outline of the method of braiding the braiding member, and the method of forming the outside diameter of the external conductor 3 will now be described with reference to FIG. 4.

The tape-wound insulated core 5 which was obtained by winding the porous tape 21 around the outer circumference of the internal conductor 1 and which was formed with the precision for a predetermined outside diameter to have the predetermined outside diameter is supplied to a braiding device 40 and is then inserted through first and second guide dies 41 and 42, and forming dies 43 of the braiding device 40.

The first guide dies 41, in addition to the performing of the guide for the insulated core 5, form the insulated core 5, before the braiding, with the precision for a predetermined outside diameter to have the predetermined outside diameter. The insulated core 5 passed through the first guide dies 41 is woven with strand for braiding 44 by rotation of the braiding device 40 which have a plurality of strand for braiding 44 and which rotates alternately in reverse direction, and are braided around the outer circumference of the insulated core 5 immediately before the second guide dies 42. The second guide dies 42 guide the external conductor 3 and also form the outer circumference of the external conductor 3.

The external conductor 3 passed through the second guide dies (dies for braiding) 42 is inserted into the forming dies 43 which are 1.50 mm in inside diameter and 3.00 mm in inside diameter length, and is formed by the forming dies 43. The braiding member is drawn in its length direction to be narrowed through the forming. As a result, the void portions in the external conductor 3 itself are removed, the external conductor 3 is brought in tighter contact to the insulator 2, the void portions defined between the external conductor 3 and the insulator 2 are removed, the inside diameter of the external conductor 3 is closer to the outside diameter of the insulator 2, the ununiformity in thickness, the irregularities of the outside diameter, the dispersion in outside diameter, and the like in the external conductor 3 are reduced, the external conductor 3 is close to the right circle cylindrical shape, the characteristic impedance is fixed, and the variation in characteristic impedance is reduced.

EXAMPLE 1

The reduction rate (compressibility) of the outside diameter of the insulator 2 was changed, and the insulated core 5 was formed under this condition by utilizing the method described in the embodiment of the present invention. The dispersion in outside diameters of the respective insulated cores 5 was then examined. A conductor which was obtained by stranding seven annealed copper wires was used as the internal conductor 1. In this case, the annealed copper wire was plated with silver, and was 1 μm in thickness and 0.16 mm in outside diameter, and its outside diameter precision was set at 2/1000 mm or less. A tape having a porosity of 80% was used as the porous tape 21. The winding angle of the tape was set at 80°, and the winding tensile force was set at 0.70 kg/mm$^2$. TABLE 1 shows the results.

TABLE 1

TABLE 1, relation between insulator outside diameter compressibility and dispersion of insulated core outside diameter

| Insulator outside diameter compressibility (%) | Dispersion of insulated core outside diameter |
|---|---|
| 0 | 0.008 |
| 4 | 0.004 |
| 10 | 0.006 |

When the compressibility of the outside diameter of the insulator 2 was increased (by 10%), the drawing force when the coaxial cable passed through the forming dies in the phases of the forming of the external shape and the outside diameter become large, and the insulated core 5 was stretched and then was broken. When the outside diameter of the insulator 2 was compressed at a rate of 3 to 5%, especially, 4%, and the forming was performed, the most satisfactory results were obtained.

EXAMPLE 2

The biting rate at which the braiding member was bitten in the insulator 2 (the insulated core 5) was changed, and the coaxial cable 10 was formed under this condition by utilizing the method described in the embodiment of the present invention. The dispersion of the braiding outside diameters and the dispersion of the characteristic impedances in the respective coaxial cables 10 were then examined. TABLE 2 shows the results. The strand for braiding used in the braiding member is an annealed copper wire with two-layer plating which was obtained by plating a silver plated annealed copper wire having a thickness of 1 μm with a tin alloy (0.75% copper) having a thickness of 0.5 μm. The dispersion of the characteristic impedances was measured by utilizing a TDR measuring method to obtain a standard deviation.

TABLE 2

TABLE 2, relation between biting rate of braiding member, dispersion of braiding outside diameters and dispersion of characteristic impedances

| Biting rate of braiding member (%) | Dispersion of braiding outside diameters | Dispersion of characteristic impedances |
|---|---|---|
| 5 | 0.008 | 0.465 |
| 15 | 0.005 | 0.342 |
| 25 | 0.003 | 0.199 |
| 35 | 0.004 | 0.250 |

The biting rate of the braiding member was increased, whereby the insulator and the braiding member were integrated with each other, the right circleness of the braiding member was improved, and the dispersion of the characteristic impedances could be reduced. However, when the biting rate was set at 35% or more, the frictional resistance between the forming dies and the braiding member increased, the breaking of wire was easy to occur, and the flexibility of the cable was impaired. Therefore, the biting rate is desirably set smaller than 35%. According to the present invention, the precision of the characteristic impedance can be set at ±1 Ω, ±0.5 Ω, and ±0.35 Ω.

EXAMPLE 3

The biting rate at which the braiding member was bitten in the insulator 2 (insulated core 5) and the kind of plating for the strand for braiding were changed, and the coaxial cable 10 was formed under this condition by utilizing the method described in the embodiment of the present invention. The coaxial cables 10 were then wound around mandrel rods each having an outside diameter of 5 ϕ five times, respectively. A change in characteristic impedance (bending test), and the flexibility of the coaxial cable 10 (flexibility test) at that time were examined. TABLE 3 shows the results. A silver plated annealed copper wire having a thickness of 1 μm, and an annealed copper wire with two-layer plating which was obtained by plating the silver plated annealed copper wire having a thickness of 1 μm with a tin alloy (0.75% copper) having a thickness of 0.5 μm were used as the strand for braiding used in the braiding member.

In the bending test, the characteristic impedance (A) of each of the cable pieces, each having a length of 500 mm, into which the original cable was cut was measured, and the central portion, having a length of about 200 mm, of each of the cable pieces was wound around the mandrel rod having an outside diameter of 5.0 mm five times by using a tensile force of 200 g, and in this state, the characteristic impedance (B) was measured. The change in characteristic impedance was obtained from (A)-(B). This test is an alternative test in which the mechanical stress such as bend, or torsion which the cable may normally receive is applied to the cable, and in this state, the change in characteristic impedance is obtained.

In the flexibility test, a bench mark having a length of 72 mm was marked nearly on the central portion of the cable having a length of 150 mm, and two test pieces were left at a temperature of 23±2° C., and at a relative humidity of 65% or less for 2 hours. A value of a force by which the both ends of the two test pieces were compressed to 40 mm was obtained. The results are expressed by using the following marks.

TABLE 3

TABLE 3, relation among biting rate of braiding member, kind of plating for braiding strand, change in characteristic impedance, and flexibility of cable

| Biting rate of braiding member (%) | Change in characteristic impedance: Only silver plating | Change in characteristic impedance: Two-layer plating of Ag and Sn alloy | Flexibility of cable |
|---|---|---|---|
| 5 | 12.10 | 6.94 | ◎ |
| 15 | 9.60 | 5.31 | ○ |
| 25 | 6.90 | 4.03 | ○ |
| 35 | 6.21 | 3.92 | Δ |

◎: large flexibility,
○: middle flexibility,
Δ: small flexibility.

Application of two-layer plating of Ag and an Sn alloy (0.75% Cu) to the strand for braiding resulted in that the frictional resistance of the surface of the strand was reduced, so that when the mechanical stress such as bend, torsion, or slide was applied to the cable, each of the strands of the braiding member was easy to move, the stress was dispersed, the shape of the braiding member was maintained, and thus the change in characteristic impedance could be reduced. According to the present invention, even in the phase of application of the above-mentioned mechanical stress, the variation in characteristic impedance can be suppressed to ±5 Ω or less, ±4.5 Ω or less, and ±4 Ω or less.

In addition, from TABLE 2 and TABLE 3, the high-precision foamed coaxial cable could be obtained in which when the two-layer plating was used as the material for the strand for braiding, and the biting rate of the braiding strand was set at 15 to 25%, the dispersion of the characteristic impedance was small, the cable had the flexibility, and the change in characteristic impedance was small against the mechanical stress such as bend, torsion, or slide.

INDUSTRIAL APPLICABILITY

The high-precision foamed coaxial cable can be applied to uses as the coaxial cable and the coaxial code in the industrial apparatus for which the high-speed promotion for the transmission speed, and the improvement on the transmission precision in the information communication apparatus, and the testing/inspecting instrument or the like used in the information communication apparatus are demanded.

The invention claimed is:

1. A high-precision foamed coaxial cable including an internal conductor constructed by stranding conductors, an insulator constructed by winding a porous tape around an outer circumference of the internal conductor, and an external conductor constructed by braiding a plurality of thin conductor wires around an outer circumference of the insulator, wherein the insulator is formed to have a right circle external shape, an outside diameter of the insulator is formed smaller at a reduction rate of 3 to 5% than the outside diameter, immediately after the winding, of the insulator, the external conductor is formed to have a right circle external shape, an outside diameter of the external conductor is formed smaller at a reduction rate of 2 to 4% than the outside diameter, immediately after the braiding, of the external conductor, and precision of its characteristic impedance is set at ±1Ω.

2. A high-precision foamed coaxial cable according to claim 1, wherein a cross section of the insulator is compressively formed smaller at 90% than that, immediately after the winding, of the insulator.

3. A high-precision foamed coaxial cable according to claim 1, wherein a biting rate of the external conductor in the insulator is set equal to or larger than 10% and smaller than 35%.

4. A high-precision foamed coaxial cable according to claim 1, wherein variation in characteristic impedance when a mechanical stress in winding the high-precision foamed coaxial cable around a rod having a diameter of 5.0 mm is applied to the high-precision foamed coaxial cable falls within a range of ±5Ω.

5. A high-precision foamed coaxial cable according to claim 1, wherein precision of an outside diameter size of the internal conductor is set in a range of ±4/1000 mm, precision of an outside diameter size of the insulator is set at ±0.02 mm, and precision of an outside diameter size of the external conductor is set at ±2% of a central value of the outside diameter.

6. A high-precision foamed coaxial cable according to claim 1, wherein the porous tape has a porosity of 60% or more, and is wound around the internal conductor with a winding force of 0.70 kg/mm$^2$, at a winding interval which is 9 to 10 times as large as an outside diameter of the internal conductor, and at a winding angle of 75 to 80°.

7. A high-precision foamed coaxial cable according to claim 1, wherein the external conductor is constructed by braiding a two-layer plated annealed copper wire, having an outside diameter tolerance of ±2/1000 mm, which is obtained by plating a silver plated annealed copper wire having a thickness of 1 to 3 μm with a tin alloy having a thickness of 0.2 to 0.5 μm, and when a finished thickness in a phase of the braiding process is set as being 1, is formed to have a right circle external shape, and has variation in its thickness set at 5 to 10%.

8. A high-precision foamed coaxial cable according to claim 7 wherein the tin alloy plating contains therein tin and copper, and a content of copper is in a range of 0.6 to 2.5%.

9. A high-precision foamed coaxial cable according to claim 1, wherein the external conductor is constructed by braiding a two-layer plated annealed copper wire, having an outside diameter tolerance of ±2/1000 mm, which is obtained by plating a nickel plated annealed copper wire having a thickness of 1 to 3 μm with a tin alloy having a thickness of 0.2 to 0.5 μm, and when a finished thickness in a phase of the braiding process is set as being 1, is formed to have a right circle external shape, and has variation in its thickness set at 5 to 10%.

10. A high-precision foamed coaxial cable according to claim 9, wherein the external conductor is constructed by braiding a two-layer plated annealed copper wire, having an outside diameter tolerance of ±2/1000 mm, which is obtained by plating a nickel plated annealed copper wire having a thickness of 1 to 3 μm with a tin alloy having a thickness of 0.2 to 0.5 μm, and when a finished thickness in a phase of the braiding process is set as being 1, is formed to have a right circle external shape, and has variation in its thickness set at 5 to 10%.

* * * * *